US007213904B2

(12) United States Patent
Miyauchi

(10) Patent No.: US 7,213,904 B2
(45) Date of Patent: May 8, 2007

(54) DISCHARGE RECOVERY DEVICE AND INK-JET RECORDING APPARATUS

(75) Inventor: Yasuo Miyauchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 318 days.

(21) Appl. No.: 10/979,445

(22) Filed: Nov. 2, 2004

(65) Prior Publication Data

US 2005/0093920 A1 May 5, 2005

(30) Foreign Application Priority Data

Nov. 4, 2003 (JP) ..... 2003-374666

(51) Int. Cl.
*B41J 2/165* (2006.01)

(52) U.S. Cl. ..... 347/33; 347/30; 347/32
(58) Field of Classification Search ..... 347/22–33
See application file for complete search history.

(56) References Cited

U.S. PATENT DOCUMENTS 5,984,452 A * 11/1999 Bekki ..... 347/33

* cited by examiner

*Primary Examiner*—Stephen Meier
*Assistant Examiner*—Ly T. Tran
(74) *Attorney, Agent, or Firm*—Canon U.S.A. Inc. I.P. Div

(57) ABSTRACT

A discharge recovery device and an ink-jet recording apparatus incorporating the same. The discharge recovery device includes a wiper reciprocating to wipe a discharging surface of a recording head. The wiper touches a pivotable wiper cleaner while moving in a forward direction, and is thereby cleaned of ink. The wiper cleaner is fixed and rubs against the wiper when the wiper moves forward. A cleaner holder also covers the wiper to prevent ink scatter when the wiper in the forward direction. As the wiper moves in a backward direction, the wiper cleaner is pivoted out of contact with the wiper via a retracting device. This reliably prevents ink from scattering during the backward movement of the wiper without reducing cleaning performance of the wiper cleaner.

8 Claims, 20 Drawing Sheets

DISCHARGE RECOVERY DEVICE AND INK-JET RECORDING APPARATUS

This application claims priority from Japanese Patent Application No. 2003-374666 filed Nov. 4, 2003, which is hereby incorporated by reference herein.

BACKGROUND OF THE INVENTION

1. Field of the Invention

The present invention relates to a discharge recovery device for maintaining and recovering ink-discharging performance of a recording head that performs recording by discharging ink onto a recording medium, and to an ink-jet recording apparatus including the discharge recovery device.

2. Description of the Related Art

Ink-jet recording apparatuses perform recording by discharging ink onto a recording medium. Since ink is discharged from fine discharging outlets of a recording head, the discharging outlets are sometimes clogged by ink thickened due to an increase in dye concentration in the ink and fixing of the ink due to evaporation of a volatile component. Moreover, bubbles are sometimes produced in an ink chamber of the recording head. Bubbles interfere with normal ink supply operations. In the worst case, ink does not flow to the recording head, which seriously hinders recording.

In order to prevent such problems, some ink-jet recording apparatuses use a discharge recovery device that maintains and recovers ink-discharging performance by unclogging the recording head. The discharge recovery device includes, for example, a cap for covering a discharging surface of the recording head, a suction unit for sucking ink from the discharging outlets by producing a negative-pressure state inside the cap covering the discharging outlets, a wiper for wiping foreign materials, such as ink, off the discharging surface of the recording head, and a wiper cleaner for removing the foreign materials transferred to the wiper.

In these ink-jet recording apparatuses, in general, the discharging surface is wiped by utilizing the motion of a carriage on which the recording head is mounted. That is, a wiper-retracting mechanism (mechanism for moving the wiper into and out of contact with the discharging surface) is provided, and the carriage is moved with the wiper protruding only when needed so that the discharging surface is wiped in a direction orthogonal to rows of discharging outlets (horizontal wiping). In this case, since the wiper is away from the discharging surface when being retracted, it does not interfere with a scanning motion of the recording head during recording. In this wiping method utilizing the motion of the carriage, the wiper can be provided as a relatively simple structure.

In an ink-jet recording apparatus having a recording head in which a plurality of discharging-outlet rows corresponding to a plurality of color inks are arranged side by side in the scanning direction of the recording head (the moving direction of the carriage), since the above-described horizontal wiping means sequentially wipes the discharging-outlet rows, ink wiped off the preceding discharging-outlet row is forced into the succeeding discharging-outlet row, and consequently, inks of different colors are prone to be mixed. A vertical wiping means for moving a wiper parallel to discharging-outlet rows is used to prevent color mixture. In vertical wiping, however, it is also difficult to reliably clean the discharging surface with the wiper that remains soiled with ink. In order to maintain high cleaning performance of the wiper, a wiper-cleaning means is provided to scrape ink off the wiper with a wiper cleaner (e.g., an edge of a mold) after cleaning of the discharging surface.

However, when the wiper passes the wiper cleaner, ink adhering to the wiper may scatter and soil the interior of the apparatus because of elastic bending of the wiper and a returning motion of the wiper. In particular, when the wiper cleaner is used for the above-described vertical wiping, scattering ink sometimes adheres to, for example, a carriage guide and an encoder scale, which adversely affects normal recording operation. As a means for preventing this problem, U.S. Pat. No. 5,984,452 discloses a wiping method using a wiper cleaner that can pivot in one direction. In this method, the wiper cleaner is fixed when cleaning the wiper, and is pivoted by using kinetic energy of the wiper during a backward movement of the wiper.

In the disclosed method, however, the wiper is bent to counter the biasing spring force holding the wiper cleaner at a predetermined position. Therefore, ink sometimes scatters because of a returning force that is produced at the moment when the wiper separates from the wiper cleaner. The amount of scattering ink can be reduced by setting the biasing spring force extremely small or utilizing the weight of the wiper cleaner without the spring. In these methods, however, the wiper cleaner sometimes does not return to the normal position. Recently, an increasing number of ink-jet recording apparatuses have been using pigment-based ink having higher density and higher water resistance. However, the pigment-based ink thickens easier than dye-based ink.

For this reason, in a recording apparatus using pigment-based ink, when the ink reaches a pivot shaft of the wiper cleaner, the pivotal motion of the wiper cleaner is hindered, the wiper cleaner is not sufficiently returned to the normal position, and wiping performance is reduced. In order to overcome these problems, a sufficient biasing spring force must be ensured so that the wiper cleaner stably returns to the normal position even when ink adheres thereto. That is, the problem in ink scattering during wiper cleaning cannot be fundamentally solved by adjusting the biasing spring force of the wiper cleaner. Therefore, the art disclosed in the above publication cannot prevent ink scattering during wiper cleaning.

SUMMARY OF THE INVENTION

The present invention is directed to a discharge recovery device configured to reliably clean ink off a discharging surface of a recording head without reducing cleaning performance of a wiper cleaner. The present invention is also directed to an ink-jet recording apparatus incorporating the discharge recovery device.

In one aspect of the present invention, a discharge recovery device includes a wiper configured to wipe the discharging surface; a wiper-driving unit operable to move the wiper in at least first and second directions along the discharging surface; and a pivotable wiper cleaner configured to remove ink adhering to the wiper, wherein the wiper cleaner is pivotable between a cleaning position in which the wiper cleaner contacts the wiper as the wiper-driving unit moves the wiper in the first direction, and a retracted position in which the wiper cleaner is retracted out of contact with the wiper as the wiper-driving unit moves the wiper in the second direction. In another aspect of the present invention, a discharge recovery device includes a wiper configured to wipe ink from the discharging surface; a wiper-driving unit operable to move the wiper along the discharging surface; a wiper cleaner removing ink adhering to the wiper as the wiper contacts the wiper cleaner; and a cleaner holder pivotably supporting the wiper cleaner, wherein the cleaner holder substantially covers the wiper when the wiper cleaner is in contact with the wiper.

According to another aspect, an ink-jet recording apparatus has the above-described discharge recovery device.

Further features and advantages of the present invention will become apparent from the following description of the embodiments with reference to the attached drawings.

DESCRIPTION OF THE PREFERRED EMBODIMENTS

Figure 1:
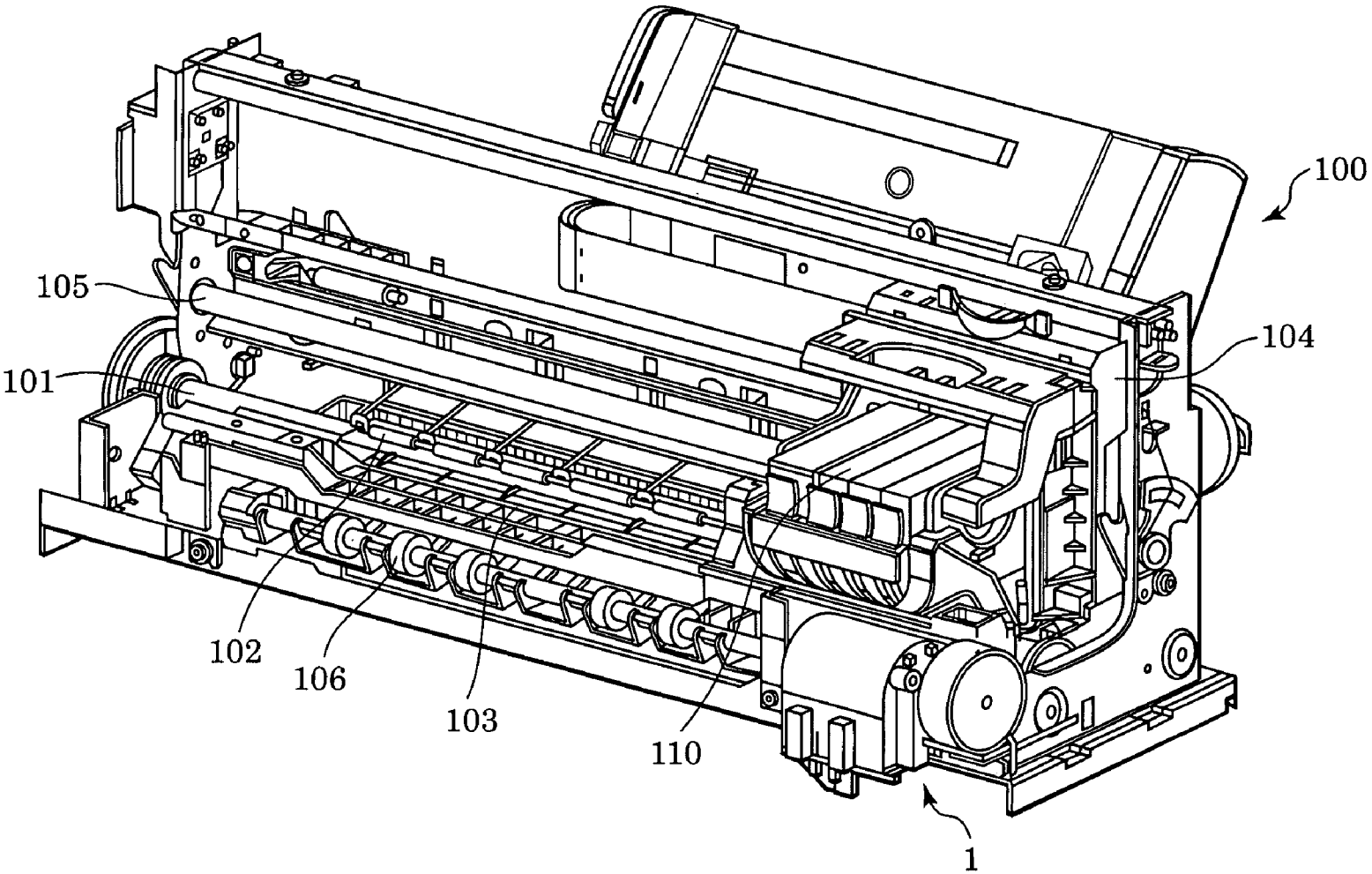
FIG. 1 is a schematic perspective view showing the inner configuration of an ink-jet recording apparatus according to a first embodiment of the present invention.

Embodiments of the present invention will be described in detail below with reference to the attached drawings. In the drawings, the same reference numerals denote the same or corresponding components.

Figure 2:
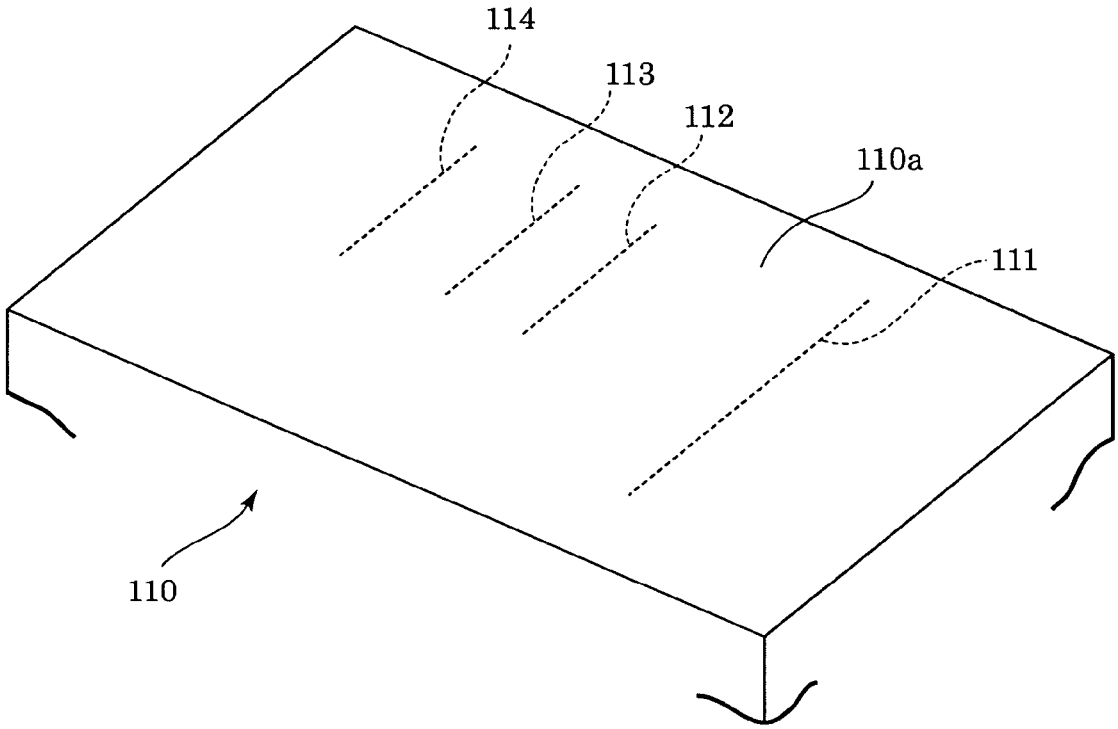
FIG. 2 is a partial perspective bottom view showing the layout of a plurality of rows of discharging outlets on a discharging surface of a recording head shown in FIG. 1.

FIG. 1 is a schematic perspective view showing the inner configuration of an ink-jet recording apparatus according to a first embodiment of the present invention, and FIG. 2 is a partial perspective bottom view showing the layout of a plurality of rows of discharging outlets on a discharging surface of a recording head shown in FIG. 1. Referring to FIG. 1, a recording medium, such as recording paper, is supplied by a sheet supply unit 100, and is conveyed onto a platen 103 while being nipped between a feeding roller 101 and pinch rollers 102. A carriage 104 on which a recording head 110 is mounted reciprocates in a main scanning direction along a guide shaft 105 at a recording position on the platen 103. One line is recorded by the recording head 110 during a main scanning operation of the carriage 104. When one line has been recorded, the recording medium is conveyed (sub-scanned) at a predetermined pitch by the feeding roller 101, and the next line is then recorded. After recording on the entire region of the recording medium is completed by repeating the above operations, the recording medium is ejected out of the apparatus by ejection rollers 106.

The ink-jet recording apparatus shown in FIG. 1 is a color recording apparatus using a plurality of color inks. As shown in FIG. 2, a plurality of (four) discharging-outlet rows, each including a plurality of discharging outlets, are provided parallel to the scanning direction of the carriage 104 on a discharging surface 110*a* of the recording head 110. The discharging-outlet rows include, for example, a black discharging-outlet row 111 for discharging black ink, a cyan discharging-outlet row 112 for discharging cyan ink, a magenta discharging-outlet row 113 for discharging magenta ink, and a yellow discharging-outlet row 114 for discharging yellow ink. At a predetermined position within the moving range of the carriage 104 and outside the passing range of the recording medium, a discharge recovery device (recovery unit) 1 is provided to maintain high ink-discharging performance of the recording head 110.

Figure 3:
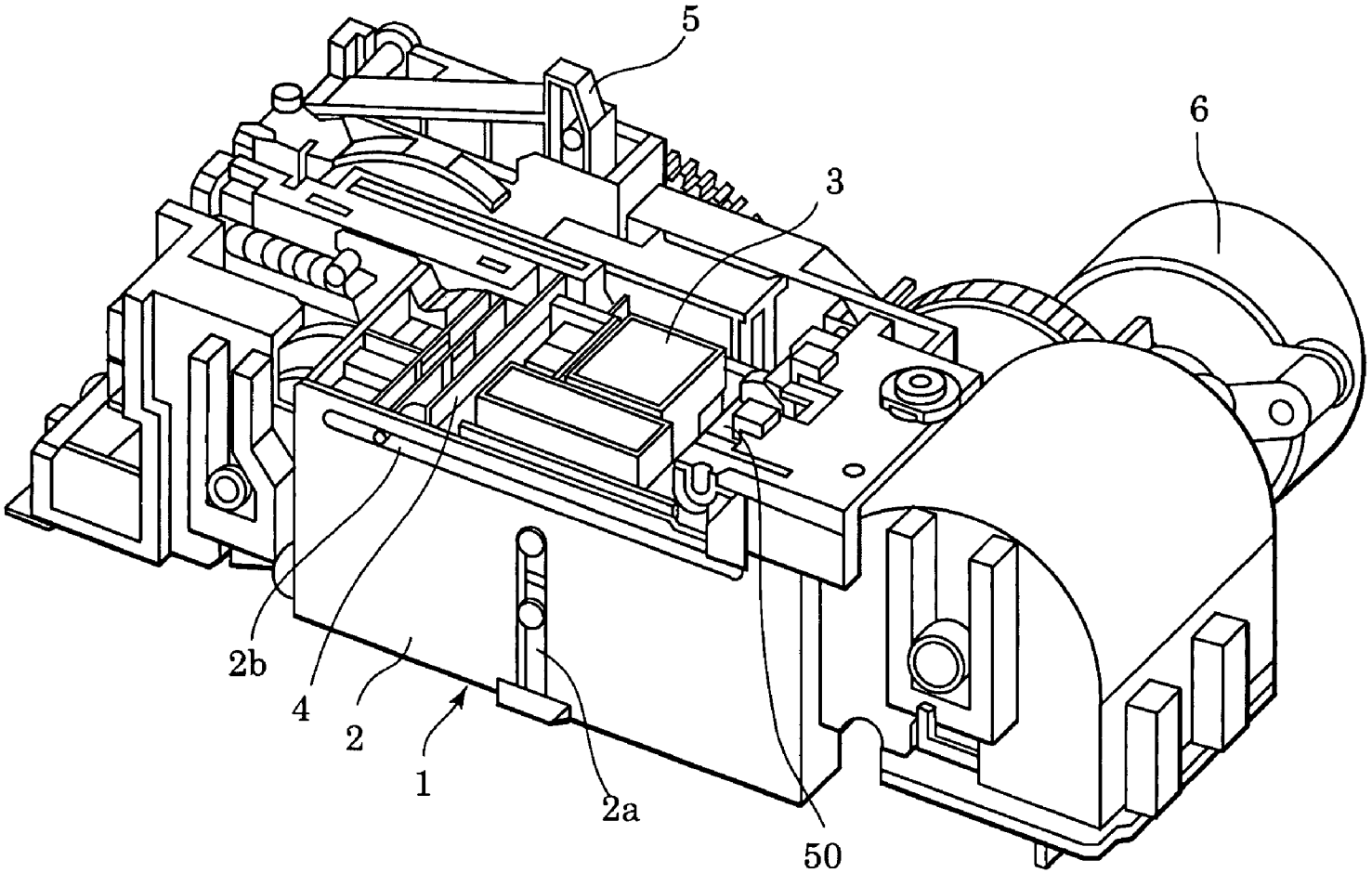
FIG. 3 is a schematic perspective view of a discharge recovery device shown in FIG. 1.
Figure 4:
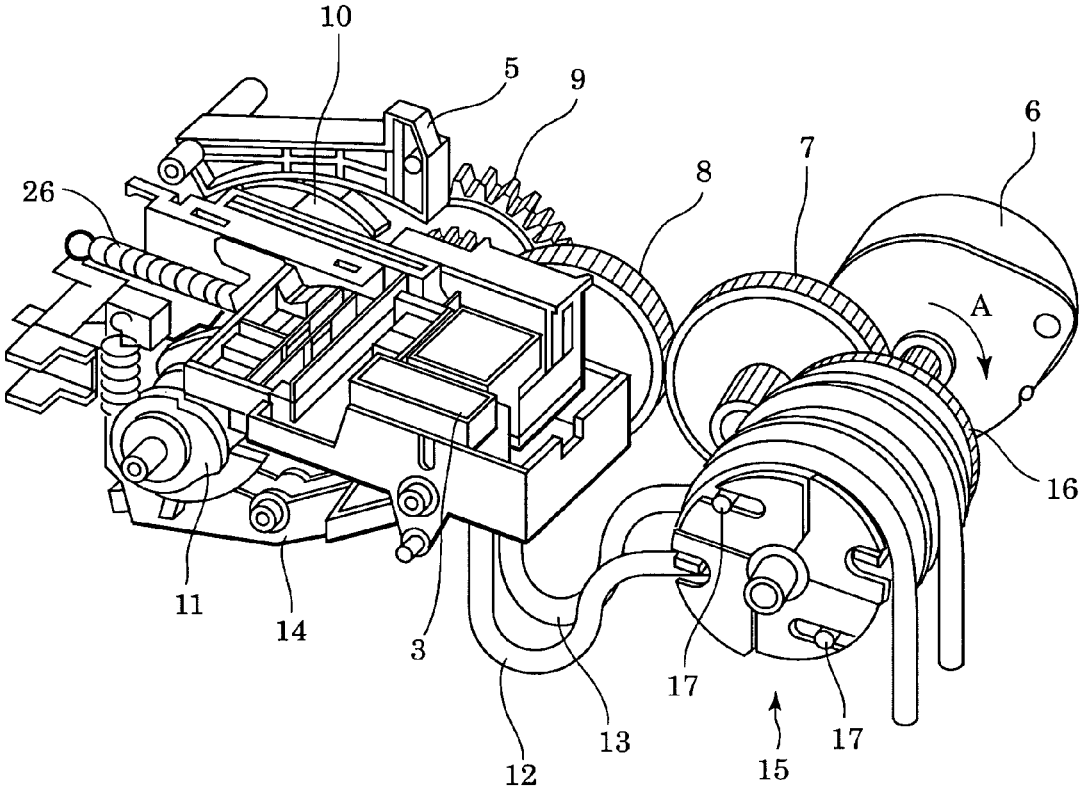
FIG. 4 is a schematic perspective view showing the inner configuration of the discharge recovery device shown in FIG. 3.

FIG. 3 is a schematic perspective view of the discharge recovery device 1 shown in FIG. 1, and FIG. 4 is a schematic perspective view showing the inner configuration of the discharge recovery device 1 shown in FIG. 3. Referring to FIGS. 3 and 4, the discharge recovery device 1 includes a cap 3 that is movable up and down along a vertical guide 2*a* of a base 2, a wiper 4 that can reciprocate along a horizontal guide 2*b* of the base 2, a pivotable wiper cleaner 50, and a pivotable carriage lock 5. The cap 3 is in tight contact with the discharging surface 110*a* of the recording head 110 to cover the discharging outlets. The wiper 4 wipes the discharging surface 110*a* (FIGS. 6 and 7) of the recording head 110. The wiper cleaner 50 removes (cleans) ink or the like adhering to the wiper 4 that has wiped the discharging surface 110*a*. The carriage lock 5 positions and fixes the recording head 110 (carriage 104) so that the recording head 110 will not improperly move relative to the discharge recovery device 1 while being covered with the cap 3.

Figure 5:
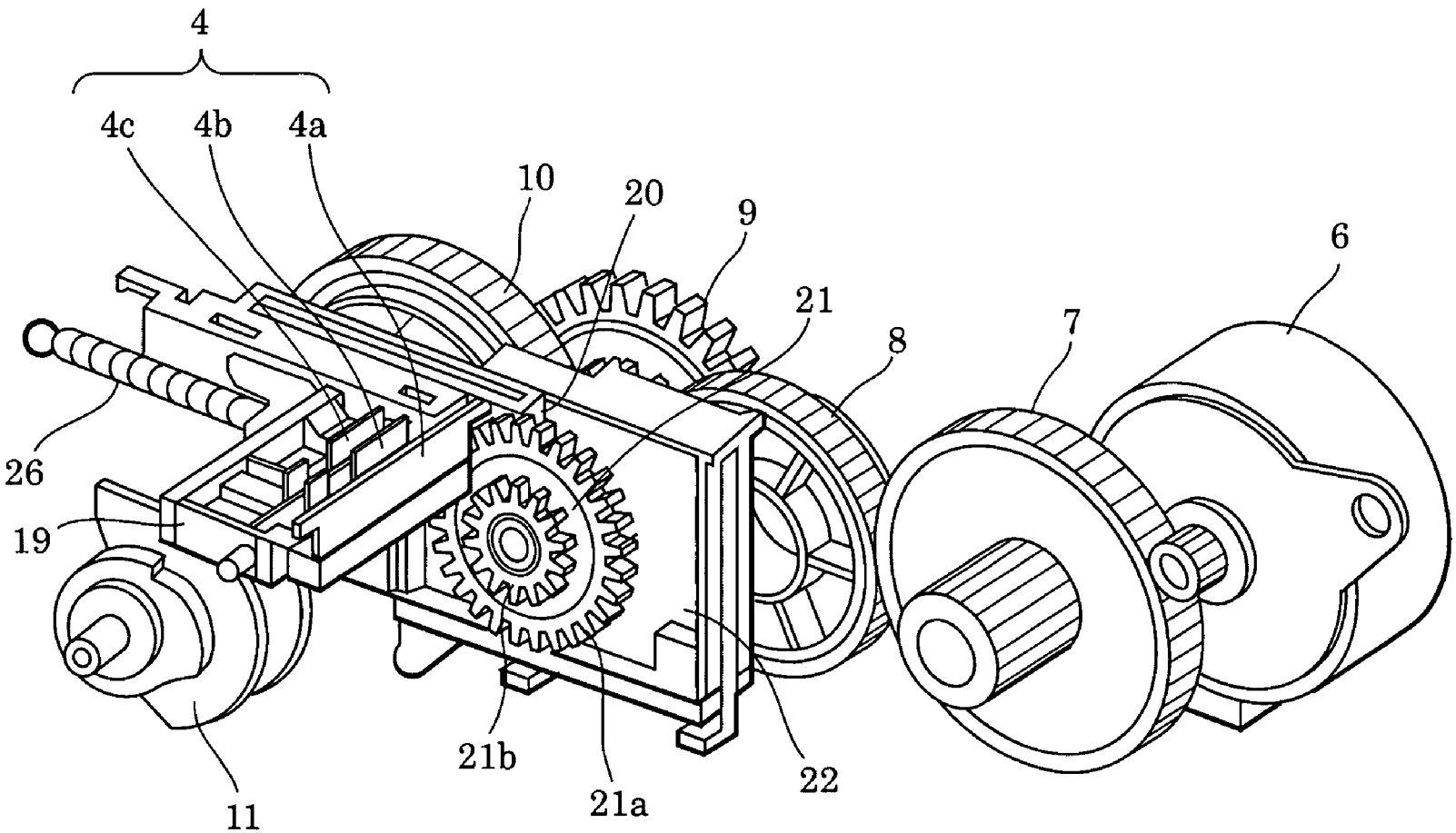
FIG. 5 is a schematic perspective view showing the structure of a wiper-driving unit for driving a wiper in the discharge recovery device.

FIG. 5 is a schematic perspective view showing the structure of a wiper-driving unit for driving the wiper 4. The motions of the above-described components of the discharge recovery device 1 are controlled by rotating a main cam 11 by a driving force in one direction of a recovery motor 6 transmitted through gears 7, 8, and 9 and a one-way clutch gear 10 shown in FIG. 4. The main cam 11 includes a plurality of cam portions arranged in the axial direction corresponding to the above components. The rotation of the main cam 11 is converted into a pivotal motion of the carriage lock 5 by a first cam portion, into a horizontal motion of the wiper 4 by a second cam portion and the wiper-driving unit shown in FIG. 5, and into a vertical motion of the cap 3 by a third cam portion and a cap lever 14. As shown in FIG. 5, the wiper 4 includes three wiper portions 4*a*, 4*b*, and 4*c*.

Referring to FIG. 4, the cap 3 has a combination of two spaces, a black-ink discharging cap space and a color-ink discharging cap space, and the cap spaces are respectively connected to tubes 12 and 13. A tube pump is defined by placing the tubes 12 and 13 along an arc-shaped guide surface (inner surface) provided in a part of the base 2. A roller-holding unit 15 is rotatably supported coaxially with the center axis of the arc-shaped guide surface, and rollers 17 for crushing the tubes 12 and 13 are rotatably supported by the roller-holding unit 15. A pump gear 16 is fixed at one end of the roller-holding unit 15. The roller-holding unit 15 is rotated by transmitting a driving force of the recovery motor 6 to the pump gear 16 through a gear 7.

With the rotation of the roller-holding unit 15, the rollers 17 rotate and revolve while crushing the tubes 12 and 13, so that the tubes 12 and 13 are squeezed. Therefore, when the tubes 12 and 13 are squeezed with the recording head 110 capped, a negative pressure is produced in the tubes 12 and 13, and acts on the cap spaces of the cap 3. Ink is sucked and discharged from the discharging outlets of the recording head 110 by the negative pressure in the cap spaces, thus recovering the recording head 110.

In the first embodiment, when the roller-holding unit 15 rotates in one direction, the rollers 17 press the tubes 12 and 13 to suck ink. That is, when the recovery motor 6 rotates in the direction of arrow A, the tube pump operates. In this case, however, since the one-way clutch gear 10 idles, the main cam 11 does not rotate. Therefore, the cap 3, the wiper 4, and the carriage lock 5 remain at a standby position. When the recovery motor 6 is reversed, the main cam 11 is rotated, and the cap 3, the wiper 4, and the carriage lock 5 are operated at a predetermined timing. In this case, the rollers 17 on the roller-holding unit 15 are guided away from the tubes 12 and 13, and the tube pump does not perform pumping (suction).

The structure and operation of the wiper-driving unit in the first embodiment will now be described with reference to FIGS. 5 to 9. The wiper-driving unit includes a wiper holder 19 for holding the wiper portions 4*a*, 4*b*, and 4*c*, a translatable slider 22, a pinion 21 rotatably supported by the slider 22, and the main cam 11 having a cam 24 engaged with (in contact with) the slider 22. The pinion 21 is integrally provided with a first gear 21*a* and a second gear 21*b*. A first rack 20 is integrally provided with a part of the wiper holder 19 so as to be meshed with the first gear 21*a*. A second rack 23 is fixed on the base 2 of the discharge recovery device 6 so as to be meshed with the second gear 21*b*. The slider 22 has bosses 22*a* that are slidably engaged with a guide groove of the base 2.

The cam 24 of the main cam 11 is engaged with (in contact with) an engaging surface 22*b* of the slider 22. Therefore, the wiper holder 19 and the wiper 4 reciprocate in the substantially horizontal direction during one-way rotation of the recovery motor 6. The wiper 4 wipes the discharging surface 110*a* while moving substantially parallel to the discharging-outlet rows 111, 112, 113, and 114 of the recording head 110 and is cleaned by the wiper cleaner 50 during a forward movement, and then returns backward to the initial position.

In the first embodiment, the height of the recording head 110 (the gap between the recording head 110 and the recording medium) can be switched in two steps. When the recording medium is cardboard, the recording head 110 can be moved to the high position. The entire discharging surface 110*a* of the recording head 110 is wiped with the wiper portion 4*a*, and the adjacencies of the discharging-outlet rows are wiped with the wiper portion 4*b* when the recording head 110 is placed at the high position, and are wiped with the wiper portion 4*c* when the recording head 110 is placed at the low position. The discharging surface 110*a* can be thereby wiped reliably.

Figure 6:
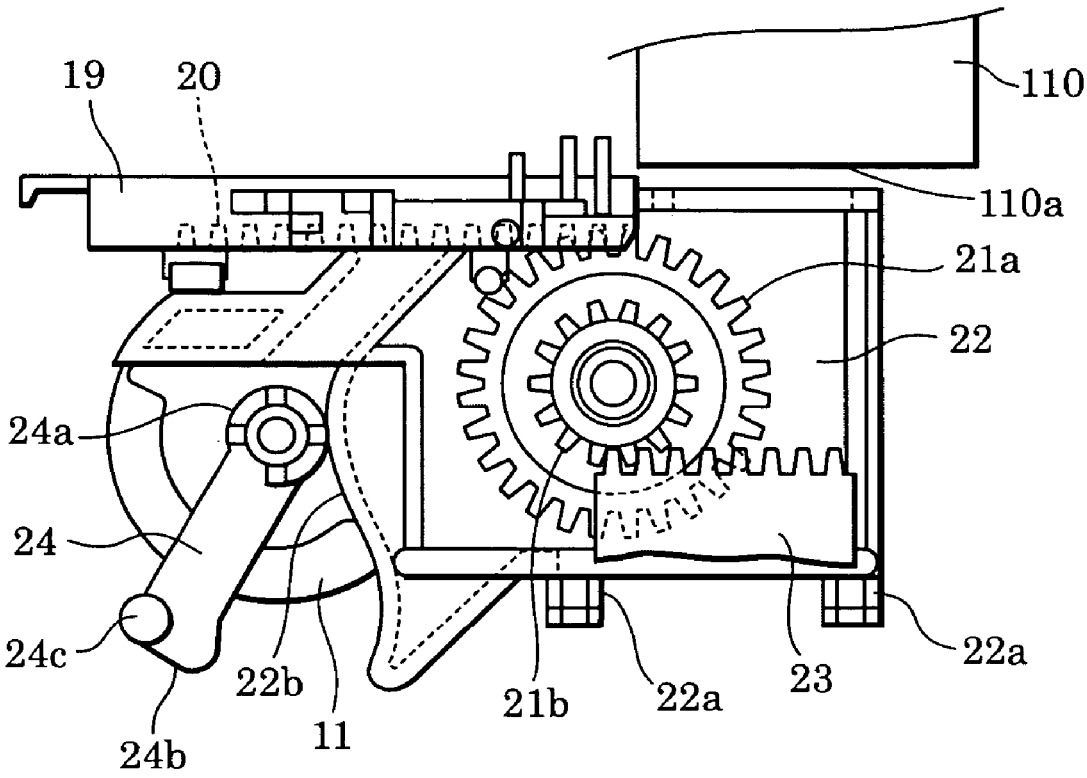
FIG. 6 is a schematic side view showing an initial state of the wiper-driving unit shown in FIG. 5.

A wiping operation and a wiper-cleaning operation will now be described with reference to FIGS. 6 to 9. When the wiper holder 19 is at the initial position, as shown in FIG. 6, the slider 22 is in contact with a cylindrical portion 24*a* at the root of the cam 24 as a part of the main cam 11, but is not in contact with a leading end 24*b* of the cam 24. That is, while the leading end 24*b* of the cam 24 is out of contact with the engaging surface 22*b* of the slider 22, the wiper holder 19 does not move even when the main cam 11 rotates. The wiper holder 19 is constantly biased in a return direction by a return spring 26 (FIG. 5), and the cylindrical portion 24*a* or the leading end 24*b* of the cam 24 is constantly in contact with the engaging surface 22*b* of the slider 22.

Figure 7:
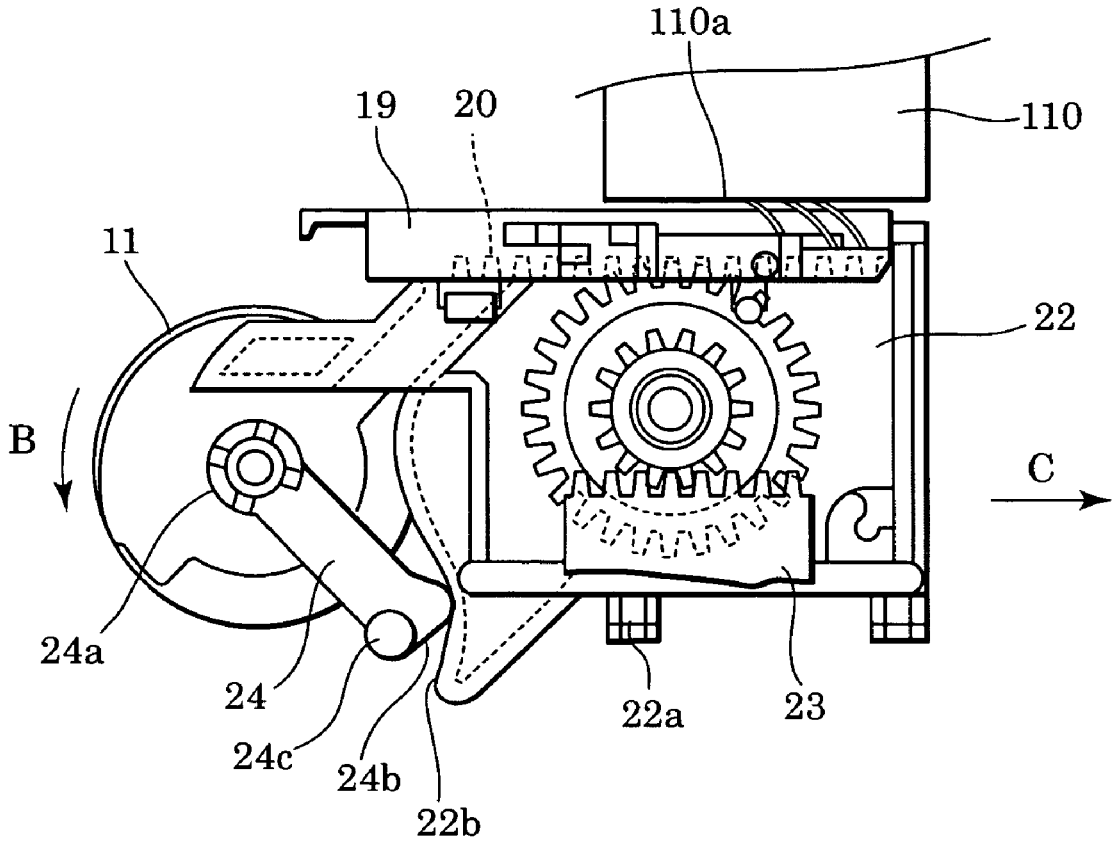
FIG. 7 is a schematic side view showing a state in which the wiper of the wiper-driving unit shown in FIG. 5 is wiping the discharging surface while moving forward.

The pinion 21 rotatably supported by the slider 22 is a two-speed gear including the first gear 21*a* and the second gear 21*b*. The first gear 21*a* is meshed with the first rack 20 provided in the wiper holder (wiper-holding unit) 19, and the second gear 21*b* is meshed with the second rack 23 provided in the base 2. The slider 22 is translatably supported with the bosses 22*a* at the bottom thereof engaged with a guide groove (not shown) of the base 2. As shown in FIG. 7, when the cam 24 is rotated in the direction shown by arrow B by the driving of the recovery motor 6 and the leading end 24*b* of the cam 24 touches the engaging surface 22*b* of the slider 22, the slider 22 translates in the direction shown by arrow C. With the movement of the slider 22, the pinion 21 also rolls because it is meshed with the second rack 23.

In the first embodiment, the number of teeth of the first gear 21*a* of the pinion 21 is 28, and the number of teeth of the second gear 21*b* is 14. That is, when the second gear 21*b* rotates by an angle corresponding to x-number teeth (x is a positive integer), the first gear 21*a* rotates by an angle corresponding to 2x-number teeth, and the wiper holder 19 can be moved relative to the slider 22 by a distance corresponding to 2x-number teeth. Therefore, a speed-increasing mechanism is provided which allows the wiper holder 19 to translate by 3L when the slider 22 translates by L. The engaging surface 22*b* of the slider 22 is curved so that a constant-speed rotation of the cam 24 can be converted into a constant-speed movement of the slider 22. In this way, the entire discharging surface 110*a* of the recording head 110 can be wiped at the optimal speed.

Figure 8:
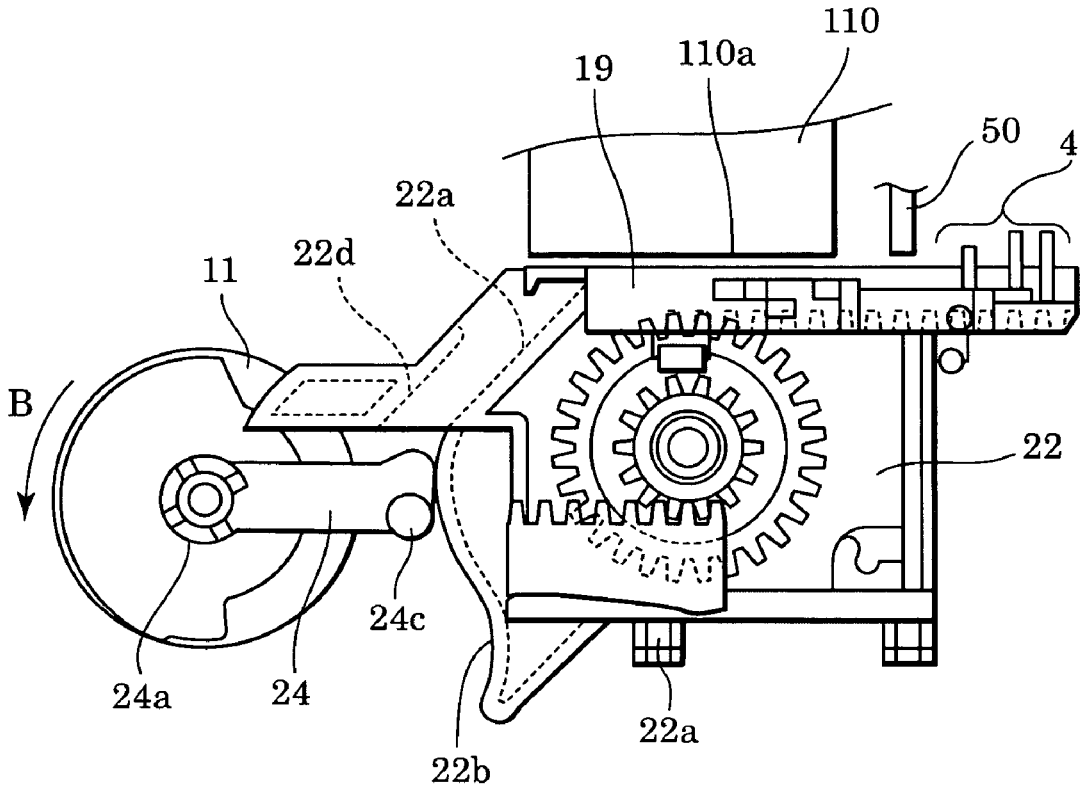
FIG. 8 is a schematic side view showing a state in which the wiper is placed at a full-stroke position forward after wiping the discharging surface and passing a wiper cleaner.

When the main cam 11 further rotates in the direction of arrow B and the cam 24 is placed at a position shown in FIG. 8, the slider 22 and the wiper holder 19 are moved to a full-stroke position. While the wiper holder 19 fully moves in the forward direction (direction shown by arrow C), the wiper 4 wipes the discharging surface 110*a*, and is then cleaned by the wiper cleaner 50. Wiper cleaning is performed to scrape ink off the wiper 4. After the wiper cleaning, the wiper holder 19 stops at the position shown in FIG. 8, and is moved in the opposite direction.

Figure 9:
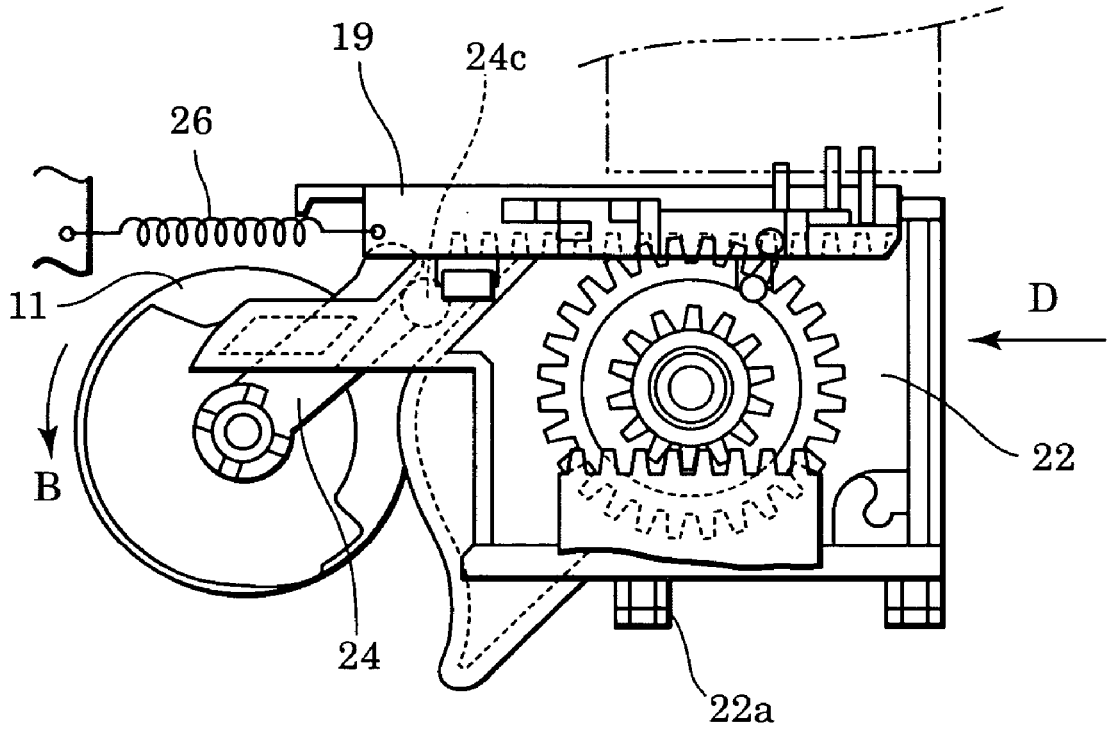
FIG. 9 is a schematic side view showing a return state in which the wiper is moving toward an initial position.

That is, after the wiper holder 19 reaches the full-stroke position shown in FIG. 8, the recording head 110 is moved in the scanning direction and is placed outside the wiping region, and the wiper holder 19 starts to be moved in the direction shown by arrow D, as shown in FIG. 9. In this case, a return force in the direction of arrow D is applied to the wiper holder 19 by the return spring 26 (FIG. 5). A pin 24*c* at the leading end of the cam 24 is normally engaged with an inclined face 22*c* of the slider 22, and prevents sound from collision from being produced by swift movements of the wiper holder 19 and the slider 22 because of the spring force of the return spring 26.

Figure 10:
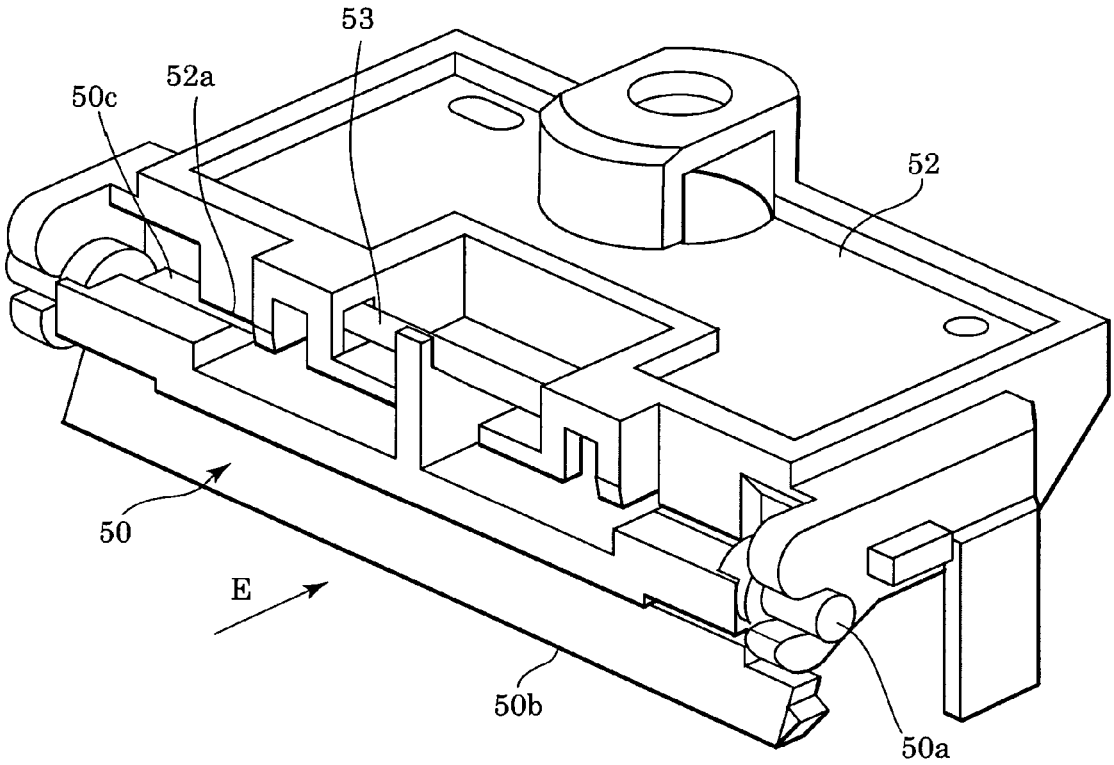
FIG. 10 is a schematic perspective view of the wiper cleaner in the first embodiment.
Figure 11:
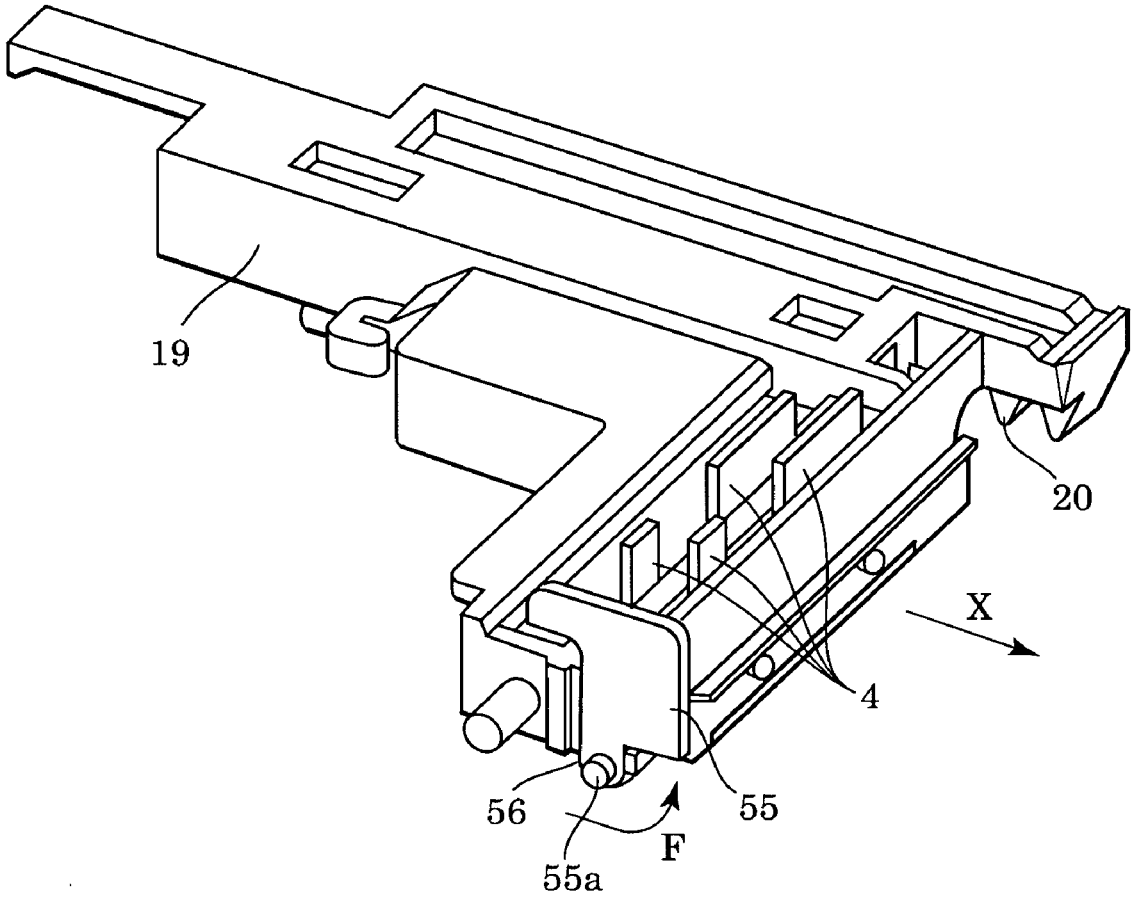
FIG. 11 is a schematic perspective view of a wiper holder in the first embodiment.

FIG. 10 is a schematic perspective view of the wiper cleaner 50, and FIG. 11 is a schematic perspective view of the wiper holder 19. The structure of the wiper cleaner 50 and a control lever 55 provided in the wiper holder 19 will be described with reference to FIGS. 10 and 11. Referring to FIG. 10, the wiper cleaner 50 is supported by a cleaner holder 52 so as to pivot on a pivot shaft 50*a*. The wiper cleaner 50 is biased by a spring 53 in one pivot direction. In a state in which the wiper cleaner 50 is biased by the spring 53, it is prevented from further pivoting by the contact of an abutting portion 50*c* with a retaining portion 52*a* of the cleaner holder 52.

That is, when a force in the direction shown by arrow E acts on a cleaning edge (a portion for cleaning the wiper 4) 50*b* of the wiper cleaner 50, the retaining portion 52*a* of the cleaner holder 52 touches the abutting portion 50*c* of the wiper cleaner 50, thereby preventing the wiper cleaner 50 from further pivoting. Such prevention allows ink adhering to the wiper 4 to be scraped off.

As the wiper 4, made of an elastic rubber material, moves in the forward direction (the direction of arrow E), the wiper 4 bends while passing through the cleaning edge 50*b*. The wiper 4 returns from the bending state to its initial state after passing the cleaning edge 50*b*. Although ink scatters in the traveling direction of the wiper 4 during this return operation, since the cleaning edge 50*b* is covered by the cleaner holder 52, soiling of the surroundings with the scattering ink can be prevented or reduced. While a small amount of ink sometimes comes out from the gap of the cleaner holder 52, and adheres onto the inner side of the housing of the apparatus, this does not cause a serious problem.

Figure 12:
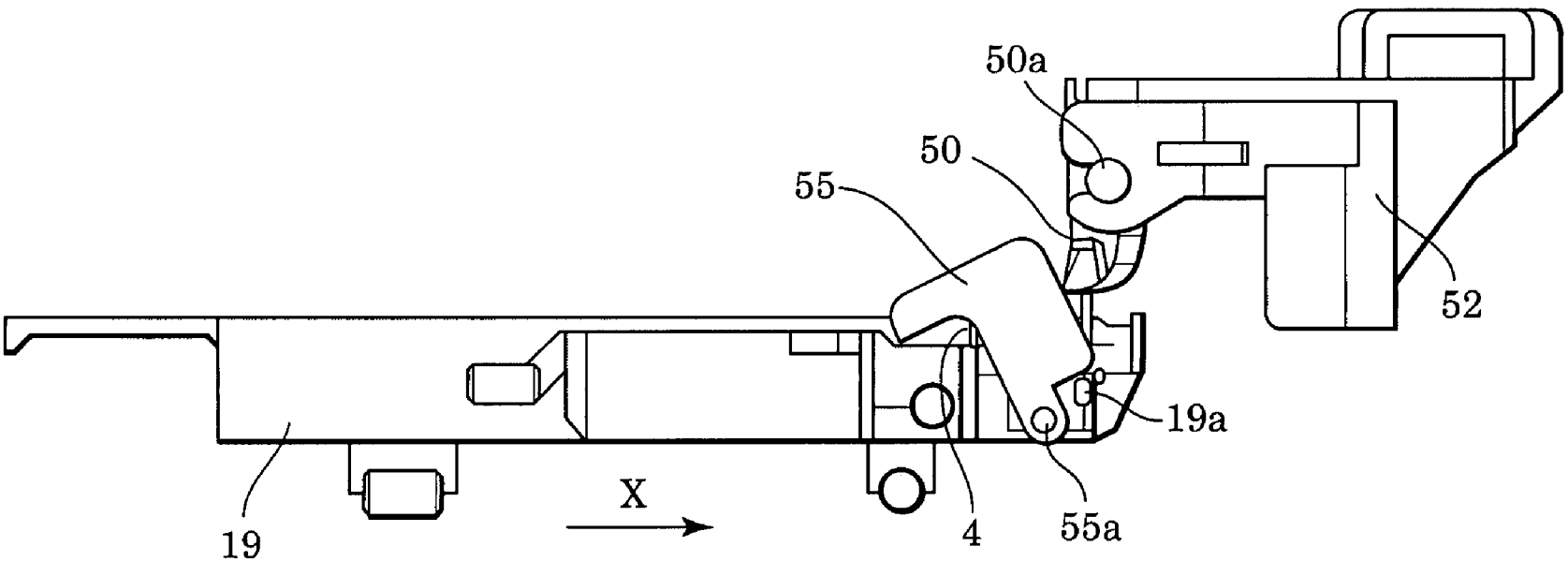
FIG. 12 is a schematic side view showing a state in which the wiper holder is moving forward and a control lever is pivoted away from the wiper cleaner before the wiper touches the wiper cleaner.

Referring to FIG. 11, the wiper holder 19 has the control lever 55 that can pivot on a pivot shaft 55*a*. When the wiper 4 (wiper holder 19) moves in the forward direction (direction shown by arrow X), as shown in FIG. 12, the control lever 55 touches the wiper cleaner 50 and pivots away from the wiper cleaner 50 (in the direction shown by arrow F). That is, when the wiper holder 19 moves in the forward X-direction to clean the wiper 4, the control lever 55 retracts and does not operate. Therefore, the wiper 4 is cleaned while in contact with the wiper cleaner 50. When the wiper 4 passes the wiper cleaner 50, the control lever 55 is returned to its initial position by a force of a return spring (helical torsion spring shown in FIG. 11) 56. At the initial position, the control lever 55 is held on standby while in contact with an abutting portion 19*a* of the wiper holder 19.

Figure 13:
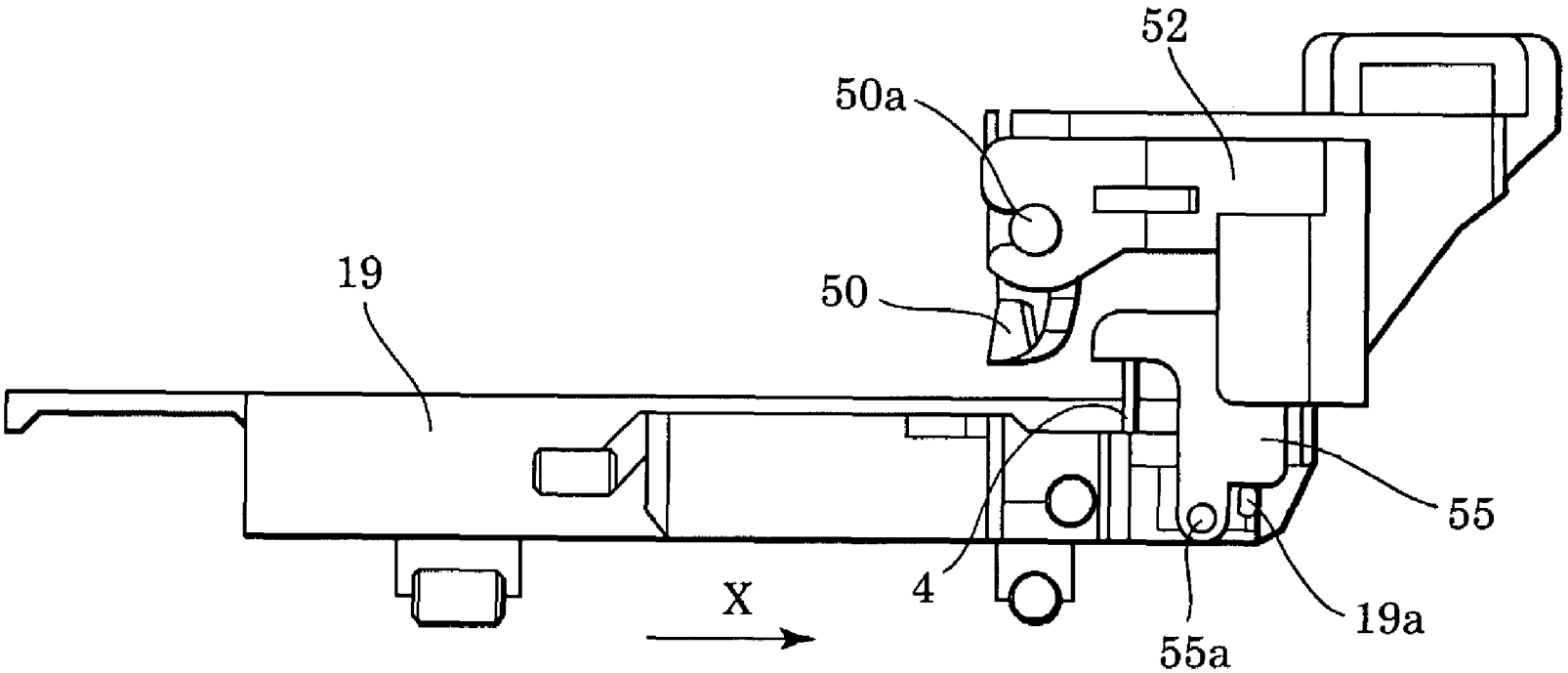
FIG. 13 is a schematic side view showing a state after the wiper holder moves forward and the wiper passes the wiper cleaner.
Figure 14:
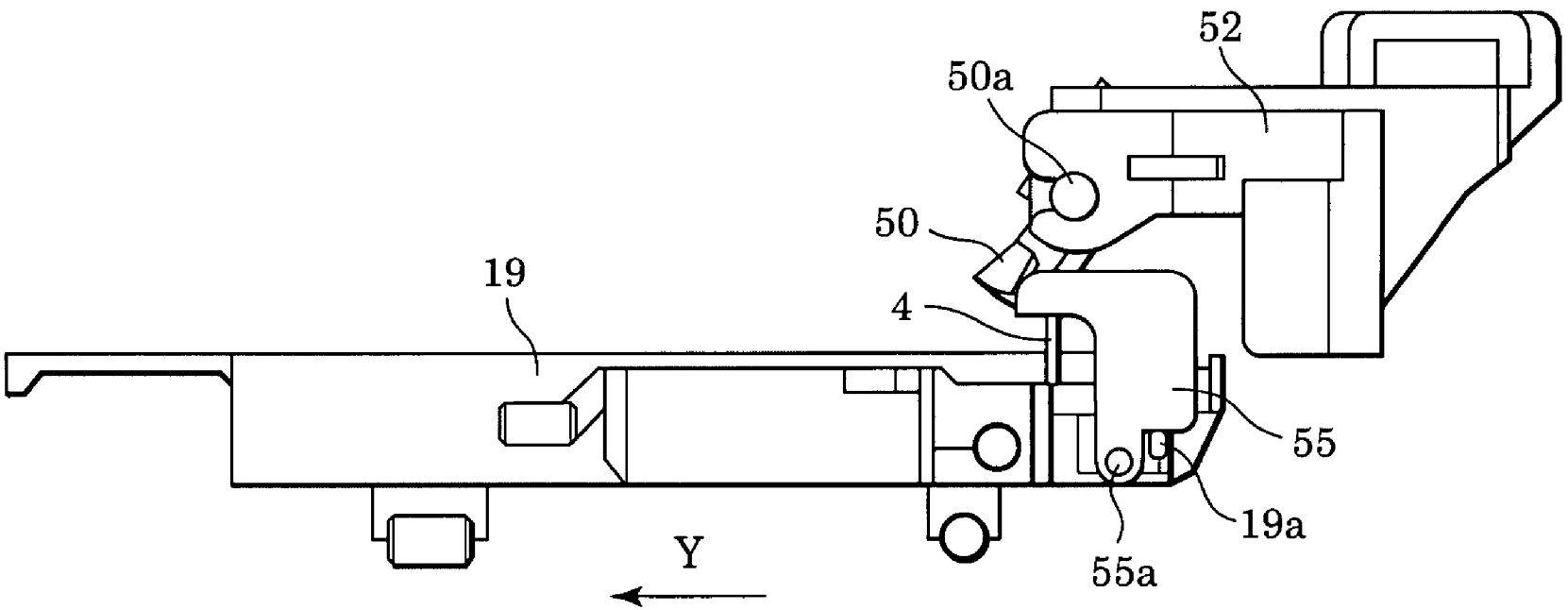
FIG. 14 is a schematic side view showing a state at the moment when the control lever touches the wiper cleaner before the wiper touches the wiper cleaner while the wiper holder moves backward.

FIGS. 12 to 15 show the operations of the control lever 55 and the wiper cleaner 50. When the wiper 4 moves in the forward direction shown by arrow X, the wiper cleaner 50 remains in a predetermined position, and the control lever 55 is pivoted to a retract position by contacting the wiper cleaner 50 immediately before the wiper 4 reaches the wiper cleaner 50, as shown in FIG. 12. Therefore, the wiper 4 is properly cleaned by the wiper cleaner 50. When the wiper 4 and the control lever 55 pass the wiper cleaner 50, the control lever 55 is returned to its initial position (standby position) by the return spring 56, as shown in FIG. 13. In FIGS. 13 and 14, the wiper holder 19 is placed substantially at the full-stroke position, and then starts to move in the backward direction (shown by arrow Y).

Figure 15:
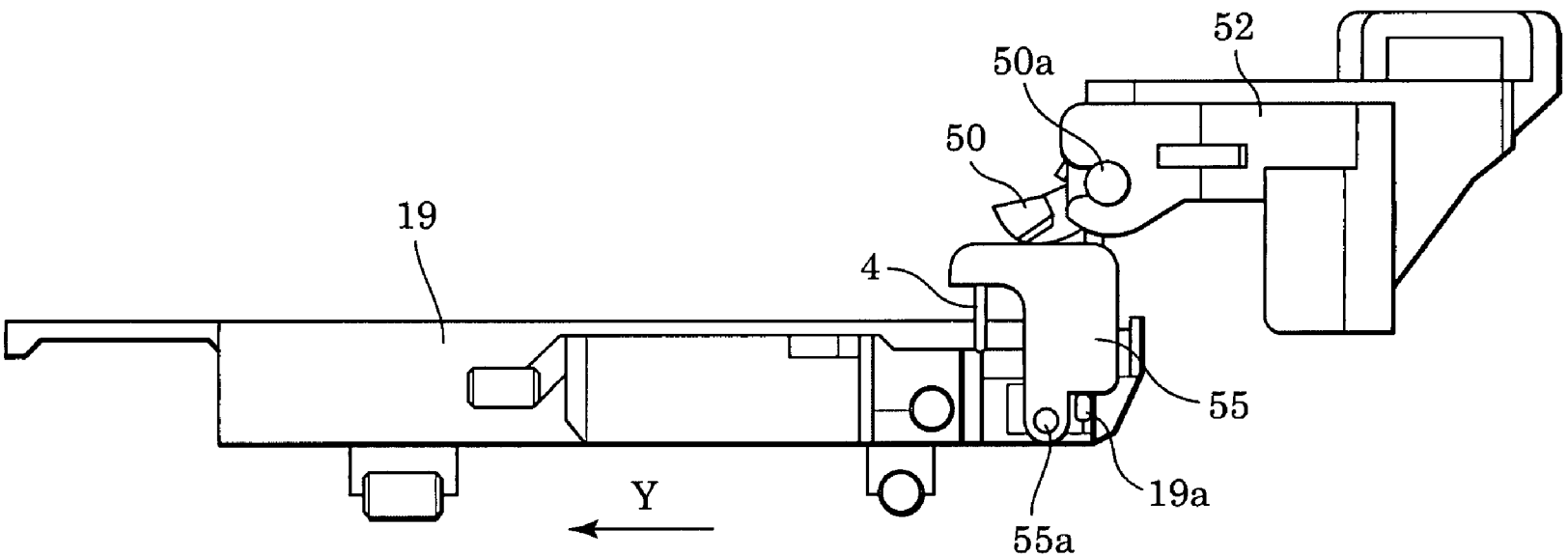
FIG. 15 is a schematic side view showing a state in which the wiper cleaner is pivoted to a retract position by the control lever while the wiper holder moves backward.

During the backward movement in the direction of arrow Y, as shown in FIG. 14, the control lever 55 touches the wiper cleaner 50 before the wiper 4 touches the wiper cleaner 50. In this case, since the control lever 55 is stopped by the abutting portion 19*a* and does not pivot clockwise, the wiper cleaner 50 is pivoted clockwise against the force of the spring 53 (FIG. 10) before the wiper 4 touches the wiper cleaner 50. Then, the wiper 4 passes the wiper cleaner 50 in a state in which the wiper cleaner 50 is pivoted away from the wiper 4 by the control lever 55, as shown in FIG. 15. In this way, when the wiper holder 19 moves in the backward direction (Y-direction), the wiper 4 and the wiper cleaner 50 do not touch each other. That is, since the wiper 4, made of an elastic rubber material for example, passes without bending, ink can be reliably prevented from scattering during the backward movement.

The wiper 4 has the three wiper portions 4*a*, 4*b*, and 4*c*, as described above. After all the wiper portions 4*a*, 4*b*, and 4*c* pass the wiper cleaner 50, the wiper cleaner 50 is disengaged from the control lever 55, and is returned to the normal position by a spring force of the return spring 53. In the discharge recovery device of the first embodiment, the discharging surface 110*a* is wiped by the reciprocating motion of the wiper 4, and the wiper 4 is cleaned by the wiper cleaner 50. By holding the pivotable wiper cleaner 50 in a normal position by a sufficient biasing spring force, a high wiper-cleaning performance can be ensured, and ink scattering can be reliably prevented. Accordingly, it is possible to prevent the interior of the apparatus from being soiled with ink, and to prevent operation failure due to adhering ink.

While the wiper 4 and the wiper cleaner 50 are out of contact with each other during the backward (Y-direction) movement in the first embodiment, similar operational advantages can be provided even when the wiper 4 and the wiper cleaner 50 are in slight contact with each other. Therefore, the present invention also covers a case in which the wiper 4 is substantially out of contact with the wiper cleaner 50 while moving backward.

Figure 16:
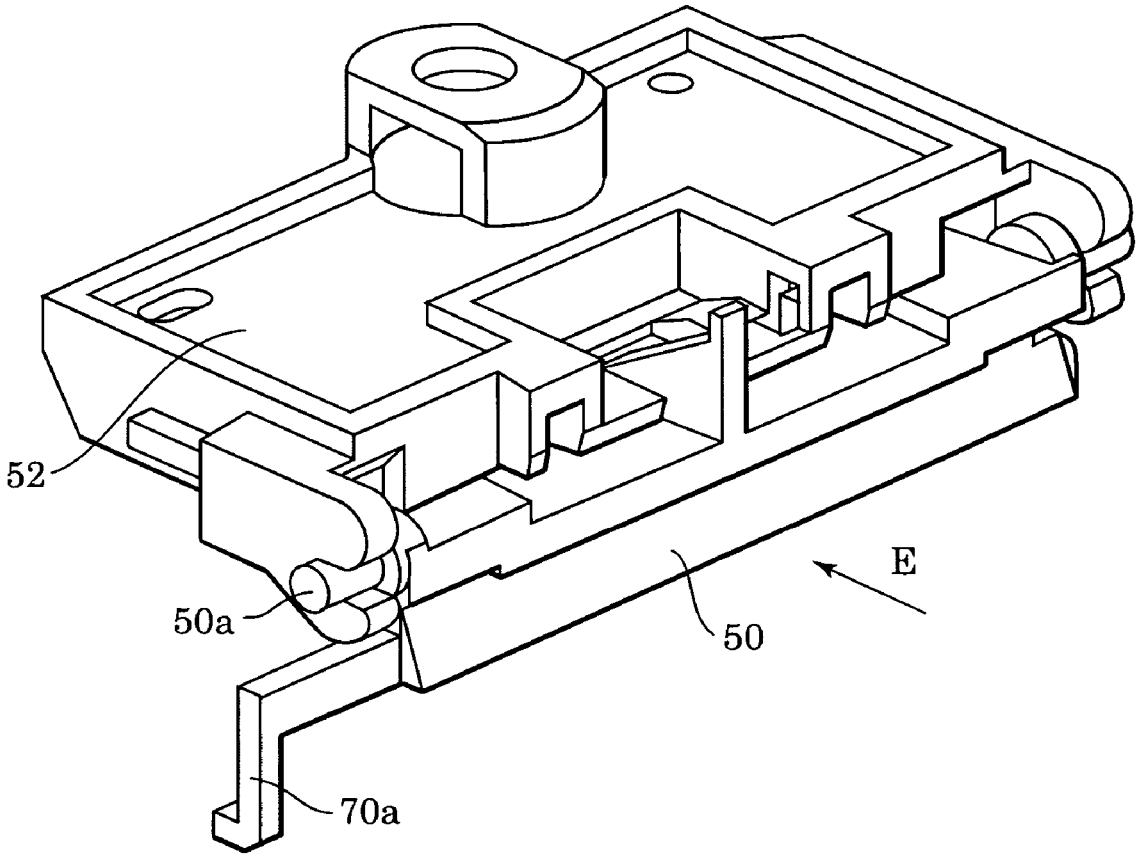
FIG. 16 is a schematic perspective view of a wiper cleaner according to a second embodiment of the present invention.
Figure 17:
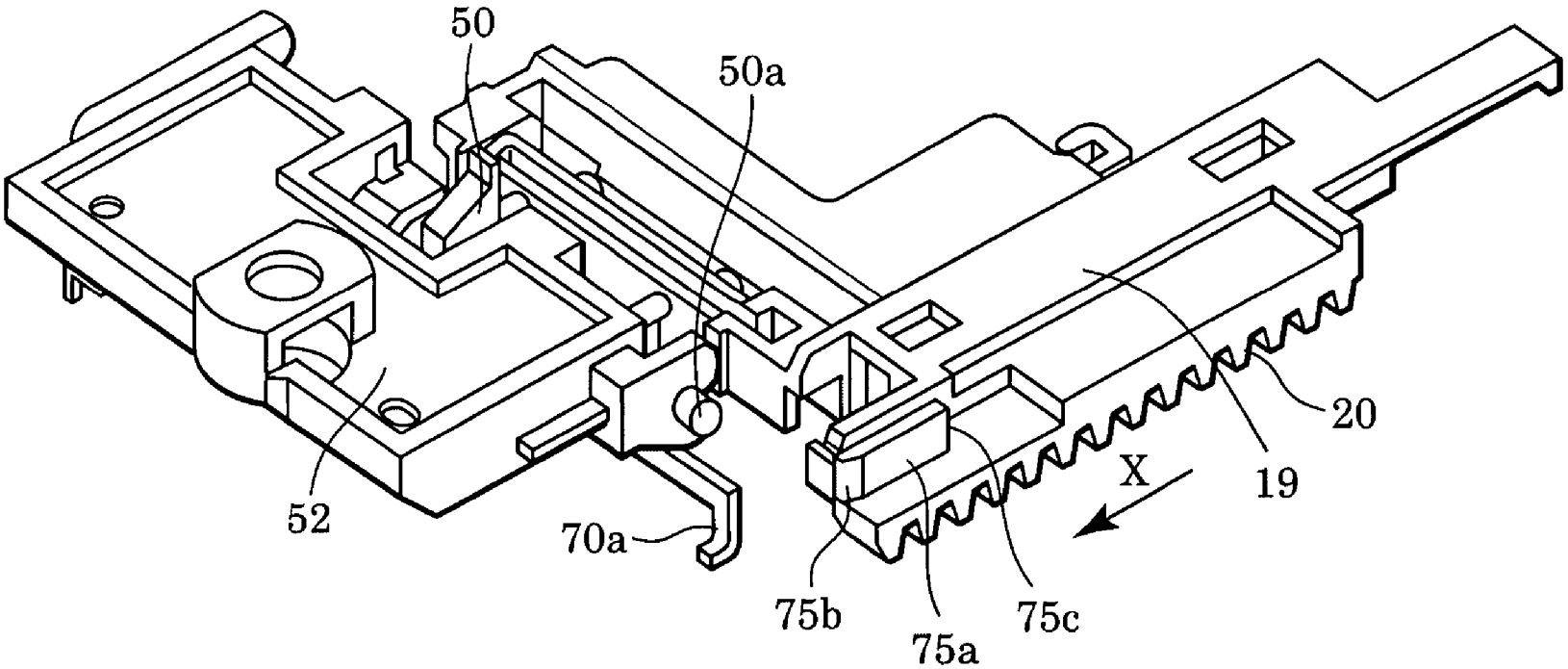
FIG. 17 is a schematic perspective view showing an initial state of a wiper holder in the second embodiment.

A second embodiment of the present invention will now be described with reference to FIGS. 16 to 20. While the wiper holder 19 is provided with the pivotable control lever 55 that is spring-biased in order to control the contact between the wiper 4 and the wiper cleaner 50 in the above-described first embodiment, the second embodiment also provides operational advantages equivalent to those of the first embodiment without adding a special component. Referring to FIGS. 16 and 17, an elastic arm 70*a* is provided integrally with a wiper cleaner 50, and an engaging rib 75*a* for contacting with the elastic arm 70*a* is provided integrally with a wiper holder 19. An inclined face 75*b* is provided at a front end in the forward direction of the engaging rib 75*a*, and a substantially vertical engaging face 75*c* is provided at a front end in the backward direction of the engaging rib 75*a*.

Figure 18:
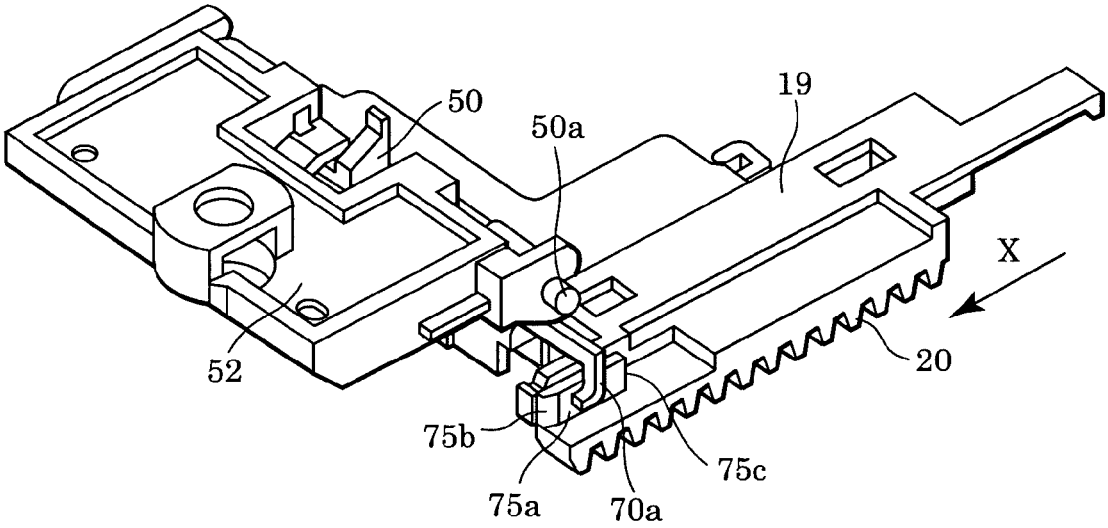
FIG. 18 is a schematic perspective view showing a state in which the wiper holder moves forward while bending an elastic arm of the wiper cleaner.
Figure 19:
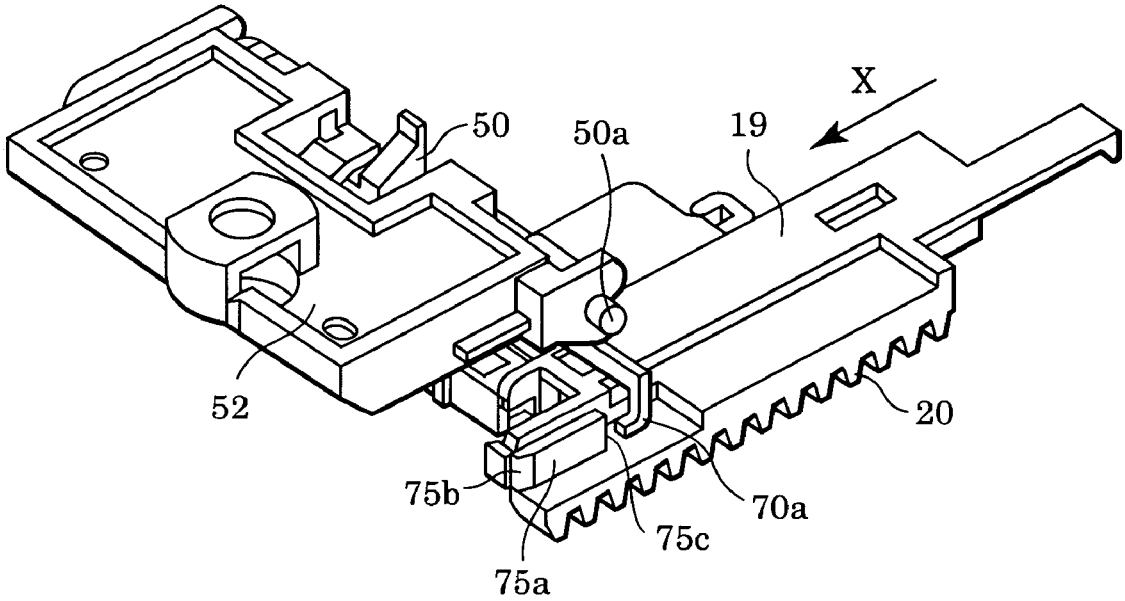
FIG. 19 is a schematic perspective view showing a state in which the wiper holder has passed the elastic arm of the wiper cleaner.

As shown in FIG. 18, when the wiper holder 19 moves in the forward direction (shown by arrow X), the wiper cleaner 50 remains in the normal pivot position. Also, the leading end of the elastic arm 70*a* is guided by the inclined face 75*b* of the engaging rib 75*a*, is elastically deformed to spread sideward, and slides on the outer surface of the engaging rib 75*a*. Therefore, in a state in which the wiper cleaner 50 is held in the normal cleaning position (normal pivot position), a wiper 4 passes the wiper cleaner 50. This ensures high wiper-cleaning performance. When the wiper holder 19 further moves in the direction of arrow X, and the elastic arm 70*a* is disengaged from the engaging rib 75*a*, as shown in FIG. 19, the elastic arm 70*a* is unbent.

Figure 20:
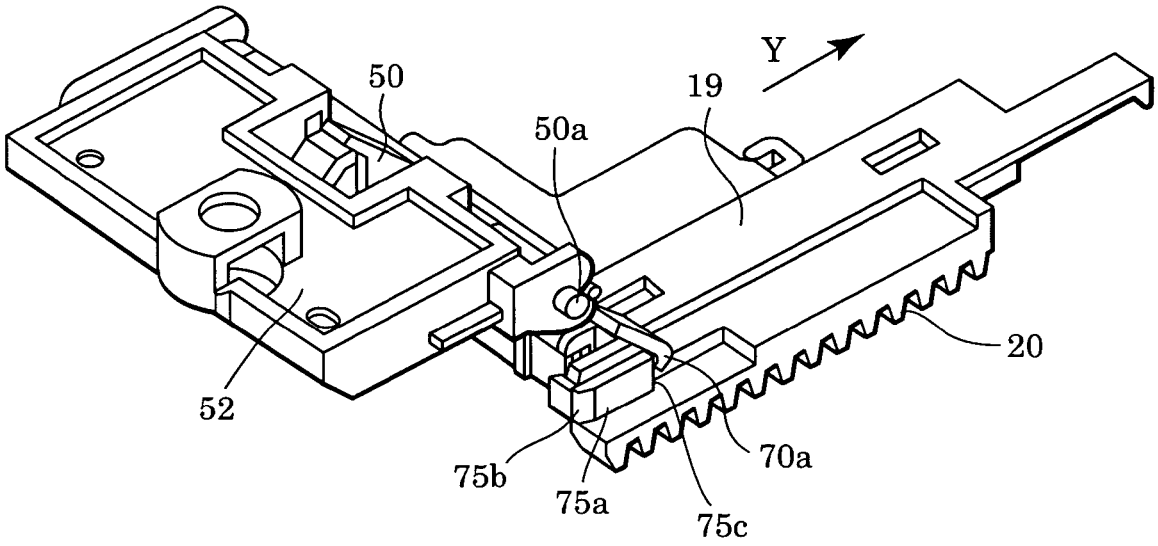
FIG. 20 is a schematic perspective view showing a state in which the wiper holder moves backward and the wiper cleaner is pivoted to a retract position out of contact with the wiper.

When the wiper holder 19 moves in the backward direction shown by arrow Y, as shown in FIG. 20, the leading end of the elastic arm 70*a* of the wiper cleaner 50 touches the engaging face (substantially vertical end face) 75*c* of the engaging rib 75*a* of the wiper holder 19. Therefore, the wiper cleaner 50 is pivoted by the wiper holder 19 so as to be out of contact with or substantially out of contact with the wiper 4. Since the wiper 4 passes the wiper cleaner 50 in this state during the backward movement, it does not touch the wiper cleaner 50, and ink does not scatter. After all the wiper portions 4*a*, 4*b*, and 4*c* of the wiper 4 pass the wiper cleaner 50, the elastic arm 70*a* and the engaging rib 75*a* are disengaged, and the wiper cleaner 50 is returned to the normal position where the abutting portion 50*c* is in contact with the engaging portion 52*a* (FIG. 10) by the biasing force of the spring 53 (FIG. 10). Then, the wiper holder 19 reaches the initial position, and the initial state is brought about.

The second embodiment has a configuration substantially similar to that of the fist embodiment except in the above-described points. In the above-described second embodiment, operational advantages similar to those of the first embodiment can be provided without adding a special component, and a cost advantage is also provided. While the elastic arm is provided in the wiper cleaner in the second embodiment, it may be provided in the wiper holder and the engaging rib may be provided in the wiper cleaner. This also provides similar operational advantages. Therefore, the present invention also covers such a structure.

In the above-described embodiments, the discharge recovery device for the ink-jet recording apparatus includes the wiper 4 for wiping the discharging surface 110*a* of the ink-jet recording head 110; the wiper-driving unit for moving the wiper 4 in a reciprocating manner along the discharging surface; and the pivotable wiper cleaner 50 for removing ink adhering to the wiper 4. The wiper cleaner 50 is prevented from pivoting and rubs against the wiper 4 to remove the ink when the wiper 4 moves forward, and pivots out of contact with the wiper 4 when the wiper 4 moves backward. Therefore, when ink adhering to the wiper 4 is removed by the wiper cleaner 50, it can be reliably prevented from scattering during the backward movement of the wiper 4 without reducing the cleaning performance of the wiper cleaner 50.

Furthermore, since the wiper cleaner 50 is biased to the predetermined position in the pivot direction by the spring 53, it properly overlaps the wiper 4. This can more efficiently provide the above-described advantages. In the first embodiment, the wiper holder 19 for holding the wiper 4 is provided with the pivotable lever 55. When the wiper 4 moves forward, the lever 55 touches the wiper cleaner 50 and pivots. When the wiper 4 moves backward, the wiper cleaner 50 touches the lever 55 and pivots. This can more efficiently provide the above advantages. In the second embodiment, the elastic arm 70*a* is provided integrally with the wiper cleaner 50, and the wiper holder 19 for holding the wiper 4 is provided with the engaging portion (engaging rib) 75*a*. When the wiper 4 moves forward, the elastic arm 70*a* touches the engaging portion 75*a* and bends to rub the wiper cleaner 50 against the wiper 4. When the wiper 4 moves backward, the wiper cleaner 50 touches the elastic arm 70*a*, and the wiper cleaner 50 pivots. This also efficiently provides the above advantages.

The present invention is similarly applicable to an ink-jet recording apparatus having a single recording head, a color ink-jet recording apparatus having a plurality of recording heads for recording with different color inks, a half-tone ink-jet recording apparatus having a plurality of recording heads for recording in the same color and at different densities, and a combination of the above ink-jet recording apparatuses. In any of the cases, similar advantages can be provided. The present invention is also similarly applicable to any arrangement of a recording head and an ink tank, for example, a case in which an exchangeable ink-jet cartridge having a combination of a recording head and an ink tank is used, or a case in which a recording head and an ink tank are separately provided and are connected by an ink supply tube. In any of the cases, similar advantages can be provided. While the present invention is also applicable to an ink-jet recording apparatus that has a recording means using an electromechanical transducer such as a piezoelectric element, it is most effectively applied to an ink-jet recording apparatus that has a recording means for discharging ink by utilizing heat energy.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A discharge recovery device for use with an ink-jet recording head discharging ink from a discharging surface, comprising:

a wiper configured to wipe ink from the discharging surface;

a wiper-driving unit operable to move the wiper in at least first and second directions along the discharging surface;

a pivotable wiper cleaner configured to remove ink adhering to the wiper, wherein the wiper cleaner is pivotable between a cleaning position in which the wiper cleaner contacts the wiper as the wiper-driving unit moves the wiper in the first direction, and a retracted position in which the wiper cleaner is retracted out of contact with the wiper as the wiper-driving unit moves the wiper in the second direction; and a retracting device operable to pivot the wiper-cleaner to the retracted position, the retracting device including:

an elastic arm attached to the wiper cleaner; and an engaging portion provided on the wiper driving unit, the engaging portion having a forward engaging surface and a rear engaging face, wherein as the wiper driving unit moves the wiper in the first direction, the elastic arm bends around the forward engaging surface of the engaging portion, and as the wiper driving unit moves the wiper in the second direction, the elastic arm contacts the rear engaging face of the engaging portion to pivot the wiper cleaner to the retracted position.

2. An ink-jet recording apparatus for forming images on a recording sheet with ink, comprising:

an ink-jet recording head operable to discharge ink from a discharging surface;

a wiper configured to wipe the discharging surface of the ink-jet recording head by reciprocating along the discharging surface;

a wiper holder configured to hold the wiper;

a wiper cleaner configured to remove ink adhering to the wiper;

a cleaner holder configured to support the wiper cleaner so as to pivot; and a control lever, provided in the wiper holder holding the wiper, configured to move the wiper cleaner to a position not contacting the wiper, wherein, when the wiper moves in a first direction, the wiper contacts the wiper cleaner, and when the wiper moves in a second direction, the wiper does not contact the wiper cleaner due to the control lever contacting the wiper cleaner before the wiper contacts the wiper cleaner.

3. The ink-jet recording apparatus according to claim 2, wherein the wiper cleaner is spring biased and pivotal motion of the wiper cleaner when contacting the wiper is controlled by contacting the cleaner holder.

4. The ink-jet recording apparatus according to claim 2, wherein the wiper moves parallel to discharging-outlet rows provided on the discharging surface.

5. An ink-jet recording apparatus comprising:

an ink-jet recording head having a discharging surface;

a wiper configured to wipe the discharging surface by reciprocating along the discharging surface;

a wiper cleaner configured to contact the wiper so as to remove ink adhering to the wiper;

a cleaner holder configured to support the wiper cleaner so as to pivot; and an elastic arm, provided integrally with the wiper cleaner, configured to move the wiper cleaner to a position not contacting the wiper, wherein when the wiper moves in a first direction, the wiper contacts the wiper cleaner, and when the wiper moves to a second direction, the wiper does not contact the wiper cleaner due to the wiper holder holding the wiper contacting the elastic arm before the wiper contacts the wiper cleaner.

6. The ink-jet recording apparatus according to claim 5, wherein the wiper cleaner is spring biased and pivotal motion of the wiper cleaner when contacting the wiper is controlled by contacting the cleaner holder.

7. The ink-jet recording apparatus according to claim 5, wherein the wiper moves parallel to discharging-outlet rows provided on the discharging surface.

8. An ink-jet recording apparatus for forming images on a recording sheet with ink, comprising:

a recording head operable to discharge ink from a discharging surface;

a carriage supporting the recording head and operable to move the recording head; and a discharge recovery device operable to remove ink from the discharging surface, including:

a wiper configured to wipe ink from the discharging surface;

a wiper-driving unit operable to move the wiper in at least first and second directions along the discharging surface;

a pivotable wiper cleaner configured to remove ink adhering to the wiper, wherein the wiper cleaner is pivotable between a cleaning position in which the wiper cleaner contacts the wiper as the wiper-driving unit moves the wiper in the first direction, and a retracted position in which the wiper cleaner is retracted out of contact with the wiper as the wiper-driving unit moves the wiper in the second direction;

a cleaner holder pivotably supporting the wiper cleaner, wherein the cleaner holder substantially covers the wiper when the wiper cleaner is in the cleaning position; and a retracting device operable to pivot the wiper-cleaner to the retracted position, the retracting device including an elastic arm attached to the wiper cleaner; and an engaging portion provided on the wiper driving unit, the engaging portion having a forward engaging surface and a rear engaging face, wherein as the wiper driving unit moves the wiper in the first direction, the elastic arm bends around the forward engaging surface of the engaging portion, and as the wiper driving unit moves the wiper in the second direction, the elastic aim contacts the rear engaging face of the engaging portion to pivot the wiper cleaner to the retracted position.

* * * * *